US005865697A

United States Patent [19]

Molitor et al.

[11] Patent Number: 5,865,697

[45] Date of Patent: Feb. 2, 1999

[54] SPORTS BALL WITH IMPROVED FEEL

[75] Inventors: Robert P. Molitor, Niles, Mich.; Terence Melvin, Somers, Conn.

[73] Assignee: Lisco, Inc., Tampa, Fla.

[21] Appl. No.: 822,671

[22] Filed: Mar. 24, 1997

[51] Int. Cl.[6] ..... A63B 41/00

[52] U.S. Cl. ..... 473/605; 473/604

[58] Field of Search ..... 473/594, 595, 473/596, 597, 599, 600, 601, 602, 603, 604, 605, 607, 612; 273/157 R, DIG. 20

[56] References Cited

U.S. PATENT DOCUMENTS

| | | | |
|---|---|---|---|
| 2,023,672 | 12/1935 | Ellis | 473/607 |
| 2,131,756 | 10/1938 | Roberts | 473/605 |
| 2,294,424 | 9/1942 | Roberts | 473/605 |
| 3,219,347 | 11/1965 | Way | 473/605 |
| 3,508,750 | 4/1970 | Henderson | 473/605 |
| 4,050,184 | 9/1977 | Chiari | 273/157 R |

*Primary Examiner*—Steven B. Wong

[57] ABSTRACT

A ball comprising an interior layer; an intermediate layer having a plurality of spacer panels extending radially outwardly from the interior layer, the panels each having interior edge located adjacent to the interior layer and an exterior edge and lateral side edges therebetween coupled to lateral side edges of adjacent panels in a waffle-like configuration to form a plurality of recesses extending downwardly from the exterior edges to thereby form a grid pattern of recesses with an exterior surface formed from the free exterior edges; and an exterior layer adjacent to the exterior surface of the intermediate layer for entrapping pockets of air within the recesses.

9 Claims, 3 Drawing Sheets

SPORTS BALL WITH IMPROVED FEEL

BACKGROUND OF THE INVENTION

1. Field of the Invention

This invention relates to sports balls with improved feel and, more particularly, to positioning an intermediate elastomeric layer in a waffle-like configuration between an exterior surface layer and an interior bladder layer of a ball.

2. Description of the Background Art

The use of balls in games and sports is known in the prior art. More specifically balls of various designs and configurations and materials heretofore devised and utilized for the purpose of improving a specific aspect of play are known to consist basically of familiar, expected, and obvious structural configurations, notwithstanding the myriad of designs encompassed by the crowded prior art which has been developed for the fulfillment of countless objectives and requirements.

Typical of balls in the prior art to which such indicia may be applied include U.S. Pat. No. 4,415,154 to Engelhardt discloses a low density hollow spherical ball. U.S. Pat. No. 4,598,909 to Ventura et al. discloses a game ball. U.S. Pat. No. 5,007,639 to Watson et al. discloses a game ball. U.S. Pat. No. 1,803,121 to Meurisse discloses a polo ball. U.S. Pat. No. 3,256,019 to Barton discloses a ball with cushioning means between cover and core. U.S. Pat. No. 3,512,777 to Henderson discloses a game ball.

Despite the large number of prior art patents to sports balls, no prior art disclosure deals with the capability of functioning with the benefit of the present invention to provide improved feel as does the present invention. Therefore, it can be appreciated that there exists a continuing need for new and improved sports balls with improved feel. In this regard, the present invention substantially fulfills this need.

Accordingly, it is an object of this invention to improving the feel of sports balls.

A further object of the present invention is to tailor the playing characteristics of sports balls for particular applications.

It is a further object of the present invention to utilize an intermediate waffle like layer in sports balls adjacent to an exterior layer.

It is a further object of the present invention to position an intermediate elastomeric layer in a waffle-like configuration between an exterior surface layer and an interior bladder layer of a basketball, football, volleyball, soccer ball or the like to enhance the feel of such ball.

It is a further object of the invention to provide a sports ball with improved feel comprising an interior layer; an intermediate layer having a plurality of spacer panels extending radially outwardly from the interior layer, the panels each having interior edge located adjacent to the interior layer and an exterior edge and lateral side edges therebetween coupled to lateral side edges of adjacent panels in a waffle-like configuration to form a plurality of recesses extending downwardly from the exterior edges to thereby form a grid pattern of recesses with an exterior surface formed from the free exterior edges; and an exterior layer adjacent to the exterior surface of the intermediate layer for entrapping pockets of air within the recesses.

These objects should be construed to merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purposes of summarizing the invention, the invention is a sports ball with improved feel through the positioning of an intermediate elastomeric layer in a waffle-like configuration between an exterior surface layer and an interior bladder layer of the ball comprising, in combination an interior elastomeric bladder layer of an air-impervious material in a spherical configuration to retain pressurized air therein during operation and use; an intermediate layer of an elastomeric material, the interior layer having a plurality of rectangular spacer panels extending radially outwardly from the interior layer, the rectangular panels each having interior edge integrally formed with the interior layer and a free exterior edge and lateral side edges therebetween coupled to lateral side edges of adjacent panels in a waffle-like configuration to form a plurality of indentations extending downwardly from the exterior edges, the depth of the indentations being between about 60 and 70 percent of the length of the exterior edges of the panels to thereby form a symmetric grid pattern of recesses with an exterior surface formed from the free exterior edges; an exterior layer of elastomeric material secured to the exterior surface of the intermediate layer to trap air within the recesses of the intermediate layer; and supplemental segments on the exterior layer forming an exterior contact surface for contact by the user of the ball.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several Figures.

DETAILED DESCRIPTION OF THE PREFERRED EMBODIMENT

Figure 1:
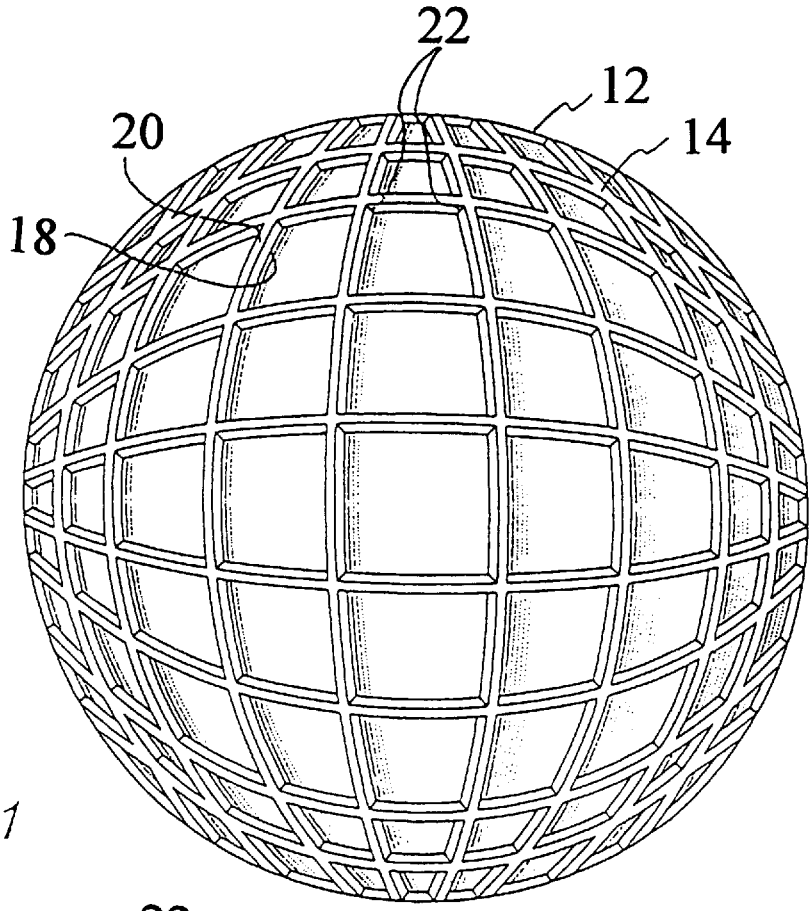
FIG. 1 is a front elevational view of an interior layer of a game ball, a basket ball, constructed in accordance with the principles of the present invention.
Figure 2:
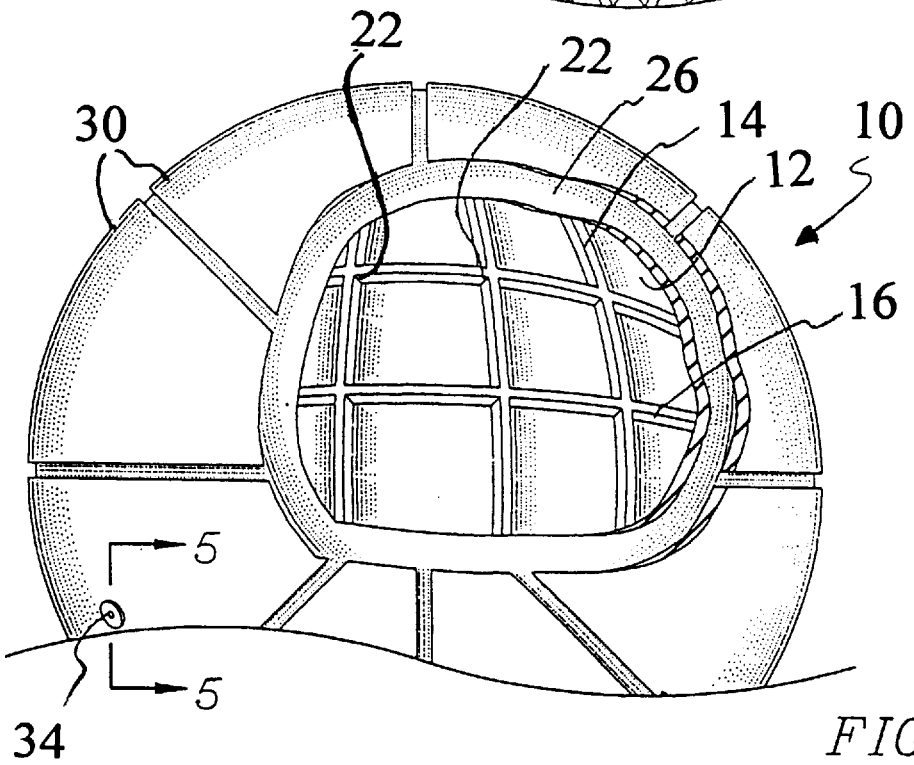
FIG. 2 is an enlarged elevational view of a game ball, a basketball, utilizing the interior layer of FIG. 1 but with parts broken away to show certain internal constructions thereof.

With reference now to the drawings, and in particular to FIGS. 1 and 2 thereof, there is shown a ball 10 having an interior layer, an exterior layer and an intermediate layer therebetween. As will be understood from a reading hereof, the ball is a sports ball, a basketball in the primary embodiment, with improved feel. This is attained through the positioning of an intermediate elastomeric layer in a waffle-like configuration between an exterior surface layer and an interior bladder layer of the ball.

One central component of the ball is an interior elastomeric bladder layer 12. Such layer is fabricated of an air-impervious material to retain pressurized air therein during operation and use. The shape of the bladder layer is spherical in configuration so as to create the spherical shape of the end product, a basketball in the embodiment of FIGS. 1 and 2.

Next provided is an intermediate layer 14, also of an elastomeric material, and preferably formed integral with the interior layer 12. The interior layer is formed to create a plurality of rectangular spacer panels 16. Such panels extend radially outwardly from the interior layer. The rectangular panels each having interior edge 18 preferably integrally formed with the interior layer. Each of the panels also has a free exterior edge 20 and lateral side edges 22 therebetween. The side edges are coupled to lateral side edges of adjacent panels in a waffle-like configuration. The panels thus form a plurality of indentations or recesses extending downwardly from the exterior edges. The depth of the recesses is between about 60 and 70 percent of the length of the exterior edges of the panels. As a result there is thereby formed a symmetric grid pattern of recesses with an exterior surface formed from the free exterior edges. The recesses are generally rectangular by vary in shape between the poles of the sphere and the equator.

An exterior layer 26 of elastomeric material is next provided. Such exterior layer is secured as by an adhesive to the exterior surface of the intermediate layer. The function of the exterior layer is to provide relative rigidity to the finished ball. The supplemental function is to trap air within the recesses of the intermediate layer.

Lastly provides are a plurality of supplemental segments 30. Such segments are positioned on the exterior layer. Such segments thus form an exterior contact surface for contact by the user of the ball.

The ball of the primary embodiment has an interior layer which is inflatable to a predetermined pressure. The effect this result, there is provided an aperture 34 for a valve. The aperture is conventional in configuration and extends through the interior, intermediate and exterior layers as described above.

More specifically, the interior layer is formed spherically and is adapted to be filled with air to constitute a bladder for the basketball, the primary embodiment. The interior bladder layer, when properly inflated with air, is adapted to provide the primary resilience to the finished basketball. The preferred material for the bladder is principally synthetic butyl rubber as is conventional for high quality basketballs but includes about 15 percent natural rubber with about 85 percent synthetic butyl rubber. The bladder has an exterior diameter of between about 230 and 240 millimeters, an interior thickness of about 0.85 millimeters and weighs between about 140 and 150 grams. The conventional basketball weighs between about 160 to 180 grams.

The cover of the basketball is formed of supplemental panels. Such panels are first cut to a shape to fit inside the spaces between the ribs as is conventional. An adhesive, preferably a contact cement such as styrene butadiene, holds the panels in place. Other suitable cements include Acrylonitrile-Butadiene-Styrene (ABS), a plastic, or a two-part urethane. An aperture is formed in one panel and extends through the layers therebeneath for passage of a valve formed integrally with the bladder, for inflating and deflating the basketball, also as is conventional.

In addition, the preferred embodiment includes an intermediate layer in a waffle type configuration which is employed underneath the covering material and above the bladder. Such intermediate layer acts to trap a multitude of air pockets or recesses that are yielding, thus enhancing the feel and the ability to grip the ball. It should be understood that while a waffle pattern was used with each segment in a generally square configuration in a lattice configurations. Such segments trap air in pockets. Other configurations such as hexagons accomplish the same desired results. Further, the present invention may readily be applied to other balls such as volley balls, foot balls, soccer balls and the like.

While the intermediary layer beneath the cover can be formed independently and applied to the carcass, it is also possible to form the intermediary layer as an integral part of the carcass when the carcass is molded by machining the desired pattern into the carcass mold.

The present invention is a sports ball, such as a basketball, volley ball, football, or the like. For the most part such balls consist of inner layer or layers to which a cover material such as leather, rubber or plastic is applied. The resultant feel and grip characteristics tend to be firm and relatively unyielding, often detracting from the feel and other desirable properties of the finished product.

The preferred embodiment of the invention also employs an intermediary layer of a waffle type patter of a desirable elastomeric material to which the cover is then applied. By virtue of the design and material properties that are chosen for this intermediary layer, one can program the dynamic and static properties of the resultant ball.

For example, a deadening effect while retaining superior grip and feel properties can be obtained through the choice of a proper energy absorbing elastomer. This is believed to be desirable for volley balls and soccer balls. Likewise, a more resilient and lively basketball, if desired, can be obtained through the choice of a property elastomer while still retaining the desired gripping properties.

This invention allows a greater latitude in construction and design and use of materials to make a superior product with tailored playing characteristics for a particular application as desired.

Figure 3:
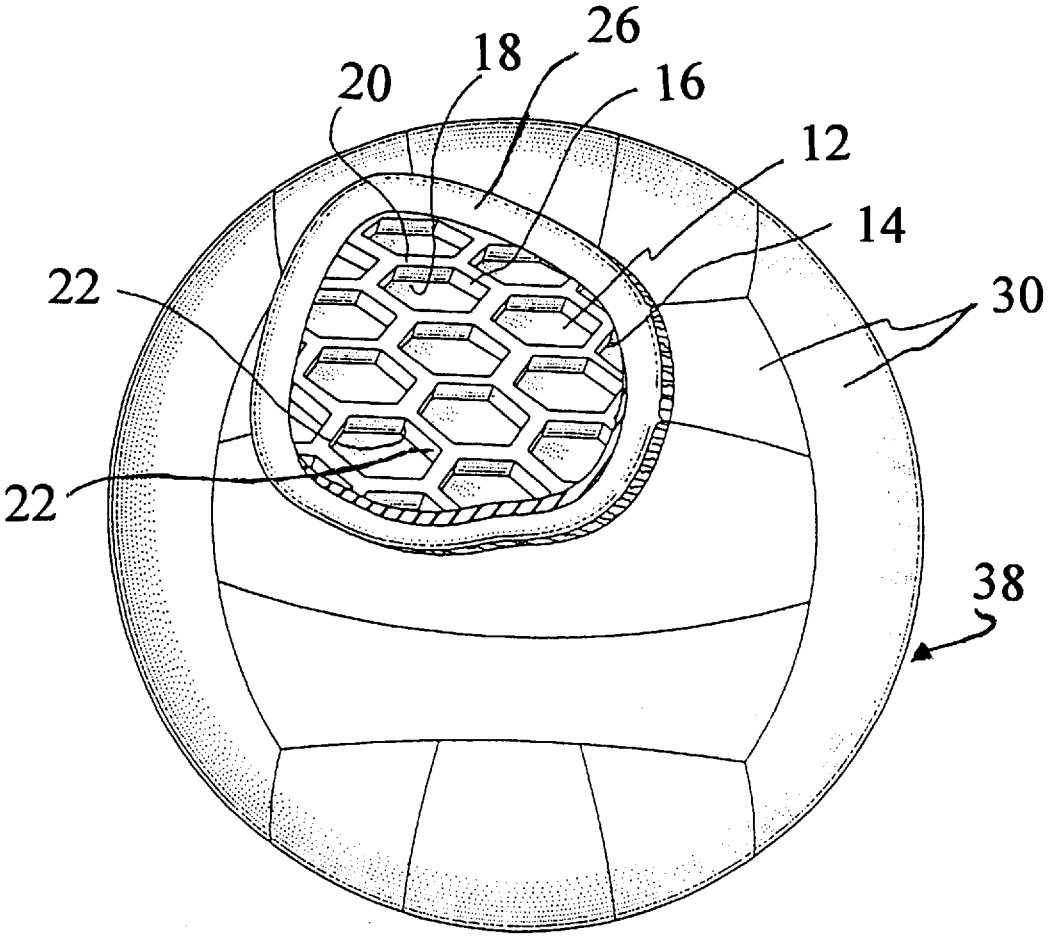
FIG. 3 is a volleyball constructed in accordance with the principles of the present invention.

In the embodiment of FIGS. 1 and 2 the finished ball is a basket ball. In the embodiment of FIG. 3 the ball is a volley ball 38, also spherical as in the primary embodiment. The embodiment of Figure is a foot ball 40. Such ball, as well as the layers and supplemental segments thereof, is ovoid in shape rather than spherical as in the prior embodiments.

Figure 4:
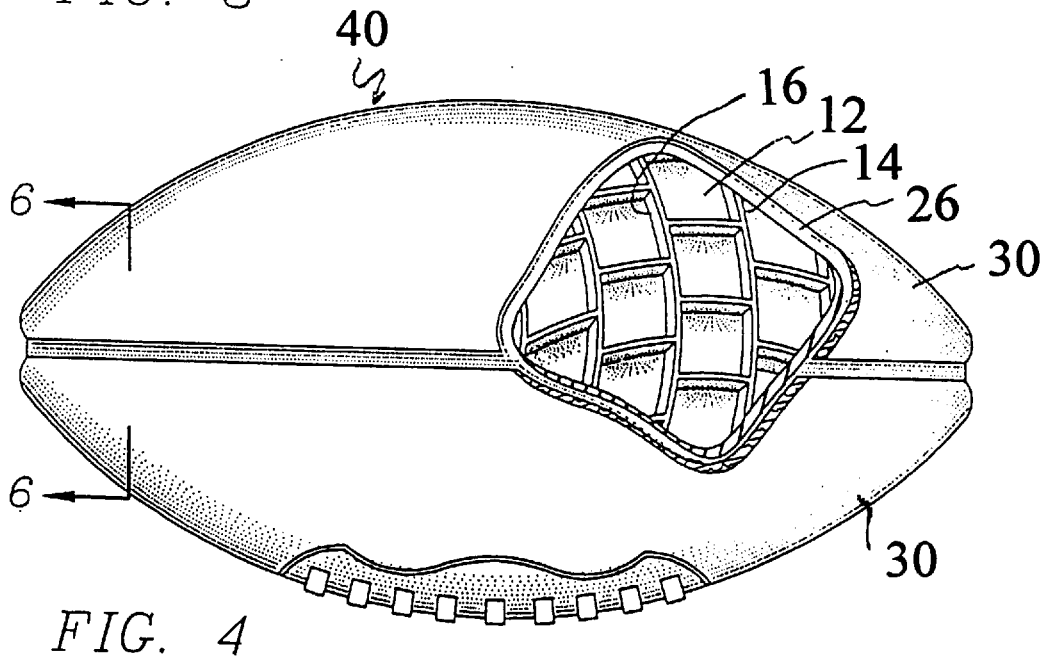
FIG. 4 is a football constructed in accordance with the principles of the present invention.
Figure 5:
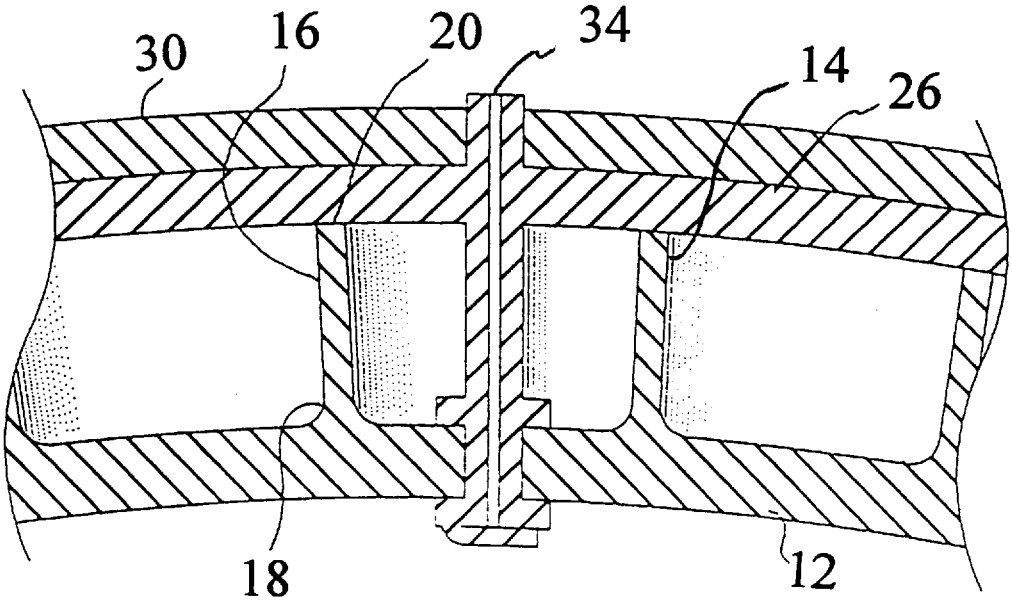
FIG. 5 is a cross-sectional view taken along line 5—5 of FIG. 2.
Figure 6:
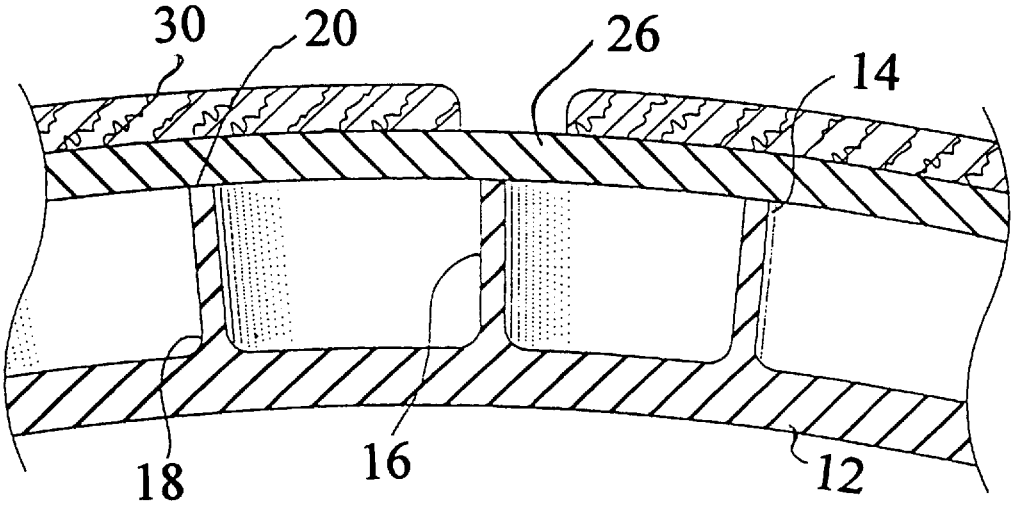
FIG. 6 is a cross-sectional view taken along line 6—6 of FIG. 4.

Note is taken that the recesses of the primary embodiment ar generally rectangular or square in shape. The rectangular recesses are in a symmetrical configuration with respect to adjacent recesses in the primary embodiment. In the FIG. 4 embodiment, the rows of rectangular recesses are offset from the rectangular recesses in adjacent rows. In the embodiment of FIG. 3, the recesses are of a six sided configuration. It should be understood that any of the various configurations of recesses could readily be applied to any of the types of balls as a function of the desired playing characteristics.

The present disclosure includes that contained in the appended claims, as well as that of the foregoing description.

Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A sports ball with improved feel through the positioning of an intermediate elastomeric layer in a waffle-like configuration between an exterior surface layer and an interior bladder layer of the ball comprising, in combination:

an interior elastomeric bladder layer of an air impervious material in a spherical configuration to retain pressurized air therein during operation and use;

an intermediate layer of an elastomeric material, the intermediate layer being formed of a plurality of rectangular spacer panels extending radially outwardly from the interior layer, the rectangular panels each having interior edge integrally formed with the interior layer and a free exterior edge and lateral side edges therebetween coupled to lateral side edges of adjacent panels in a waffle-like configuration to form a plurality of indentations extending downwardly to a depth from the exterior edges to the interior layer, the depth of the indentations being between about 60 and 70 percent of the length of the exterior edges of the panels o thereby form a symmetric grid pattern of recesses with an exterior surface formed from the free exterior edges;

an exterior layer of elastomeric material secured to the exterior surface of the intermediate layer to trap air within the recesses of the intermediate layer; and supplemental segments on the exterior layer forming an exterior contact surface for contact by the user of the ball.

2. A ball comprising:

an internally formed, one piece interior layer;

an intermediate layer being formed of a plurality of spacer panels extending radially outwardly from the interior layer, the panels each having interior edge located adjacent to the interior layer and an exterior edge and lateral side edges therebetween coupled to lateral side edges of adjacent panels in a waffle-lie configuration to form a plurality of recesses extending downwardly from the exterior edges to thereby form a grid pattern of recesses with an exterior surface formed from the free exterior edges; and an exterior layer being attached to the exterior surface of the intermediate layer for entrapping pockets of air within the recesses.

3. The ball as set forth in claim 2 wherein the ball is spherical.

4. The ball as set forth in claim 2 wherein the ball is ovoid.

5. The ball as set forth in claim 2 wherein the recesses are generally square.

6. The ball as set forth in claim 5 wherein the recesses are offset from adjacent recesses.

7. The ball as set forth in claim 2 wherein the recesses are six sided.

8. The ball as set forth in claim 2 wherein the interior layer is inflatable and further including an aperture for a valve extending through the interior, intermediate and exterior layers.

9. The ball as set forth in claim 2 and further including supplemental segments secured to the exterior layer for contact by the user of the ball.

* * * * *